US011930887B2

(12) United States Patent
Noon

(10) Patent No.: US 11,930,887 B2
(45) Date of Patent: Mar. 19, 2024

(54) PROTECTIVE UPPER FOR ARTICLE OF FOOTWEAR

(71) Applicant: NIKE, Inc., Beaverton, OR (US)

(72) Inventor: Rachael M. Noon, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 44 days.

(21) Appl. No.: 16/887,141

(22) Filed: May 29, 2020

(65) Prior Publication Data

US 2020/0375315 A1 Dec. 3, 2020

Related U.S. Application Data

(60) Provisional application No. 62/855,252, filed on May 31, 2019.

(51) Int. Cl.
*A43B 23/02* (2006.01)

(52) U.S. Cl.
CPC ..... *A43B 23/0205* (2013.01)

(58) Field of Classification Search
CPC ..... A43B 23/0205; A43B 23/0235; A43B 23/023; A43B 23/0265; A43B 23/027; A43B 5/025
USPC ..... 36/45, 131, 43, 133, 8.1
See application file for complete search history.

(56) References Cited

U.S. PATENT DOCUMENTS 1,974,543 A * 9/1934 Reymond ..... A43B 23/027 36/45
3,175,310 A * 3/1965 Macquaid ..... A43C 13/14 36/72 R
3,407,518 A * 10/1968 Macquaid ..... A43C 13/14 36/72 R
3,798,804 A 3/1974 Funck
4,656,761 A * 4/1987 Lord ..... A43B 23/087 36/77 R
4,908,963 A 3/1990 Krajcir et al.
4,949,479 A 8/1990 Ottieri
5,353,524 A 10/1994 Brier
5,437,112 A * 8/1995 Johnston ..... B29D 35/146 36/133
5,647,149 A 7/1997 Dalebout
6,082,028 A 7/2000 Demarchi
6,539,647 B2 4/2003 Diaz
6,708,348 B1 3/2004 Romay
7,231,729 B2 6/2007 Heierling et al.
8,395,861 B2 * 3/2013 Tashiro ..... G11B 19/2036 360/99.08
8,935,861 B2 1/2015 Baker et al.
(Continued)

*Primary Examiner* — Alissa J Tompkins
*Assistant Examiner* — Catherine M Ferreira
(74) *Attorney, Agent, or Firm* — Bookoff McAndrews, PLLC

(57) ABSTRACT

An article of footwear includes an upper formed of a first material, and an armor system including a shroud covering a forefoot region of the upper. The shroud includes an articulable shroud vamp having a plurality of overlapping lames arranged in series along a ball portion of the shroud, each of the lames being formed of a second material having a greater hardness than the first material. The shroud may include a toe cap covering a toe portion of the upper and a saddle covering a mid-foot portion of the upper. The shroud vamp is disposed between the toe cap and the saddle. The saddle and the toe cap may be formed of the second material. The second material may be an up-cycled polyethylene composite.

18 Claims, 7 Drawing Sheets

(56) References Cited

U.S. PATENT DOCUMENTS

| | | | | |
|---|---|---|---|---|
| 9,113,675 | B2 * | 8/2015 | DeHaven | A43B 13/141 |
| 9,572,396 | B2 | 2/2017 | McManus et al. | |
| 9,873,033 | B2 | 1/2018 | Debney | |
| 9,961,943 | B2 | 5/2018 | Klein | |
| 2002/0129517 | A1 * | 9/2002 | Diaz | A43B 23/0205 12/146 D |
| 2009/0113766 | A1 * | 5/2009 | Hooper | A43B 7/12 36/114 |
| 2011/0035963 | A1 * | 2/2011 | Baker | A43B 1/0018 36/114 |
| 2015/0216528 | A1 * | 8/2015 | Demmy | A61B 17/07207 606/139 |
| 2017/0215516 | A1 * | 8/2017 | Silva | A43B 23/0205 |
| 2017/0360140 | A1 * | 12/2017 | Siegismund | A43B 1/04 |
| 2020/0268107 | A1 * | 8/2020 | Fuerst | A43B 23/028 |
| 2020/0375315 | A1 * | 12/2020 | Noon | A43B 23/0225 |
| 2021/0037909 | A1 * | 2/2021 | Fuerst | A43B 23/0265 |
| 2021/0251340 | A1 * | 8/2021 | Rodriguez | A43B 23/026 |

* cited by examiner

PROTECTIVE UPPER FOR ARTICLE OF FOOTWEAR

CROSS REFERENCE TO RELATED APPLICATIONS

This non-provisional U.S. patent application claims priority under 35 U.S.C. § 119(e) to U.S. Provisional Patent Application Ser. No. 62/855,252, filed May 31, 2019, the disclosure of which is hereby incorporated by reference in its entirety.

TECHNICAL FIELD

This disclosure relates to an article of footwear having a protective upper.

BACKGROUND

This section provides background information related to the present disclosure which is not necessarily prior art.

Articles of footwear conventionally include an upper and a sole structure. The upper may be formed from any suitable material(s) to receive, secure and support a foot on the sole structure. A bottom portion of the upper, proximate to a bottom surface of the foot, attaches to the sole structure. The sole structure may include a layered arrangement extending between the upper and a ground-contacting surface. For example, the sole structure may include a midsole that provides cushioning during use and an outsole that provides abrasion-resistance and traction with a ground surface.

Conventional uppers are constructed of a variety of materials for providing desired characteristics of flexibility, breathability, weight, and comfort. Accordingly, uppers known in the art are typically constructed using relatively soft and/or pliable materials to maximize performance of the article of footwear. However, in activities involving periodic contact with other players, such as American football and rugby, for example, these softer materials may expose the foot of the wearer to occasional impacts. Thus, conventional uppers are designed with an eye toward balancing these often competing interests in an effort to adequately protect the foot of the wearer while concurrently maintaining desired performance characteristics.

DESCRIPTION OF DRAWINGS

Like reference symbols in the various drawings indicate like elements.

DETAILED DESCRIPTION

Figure 1:
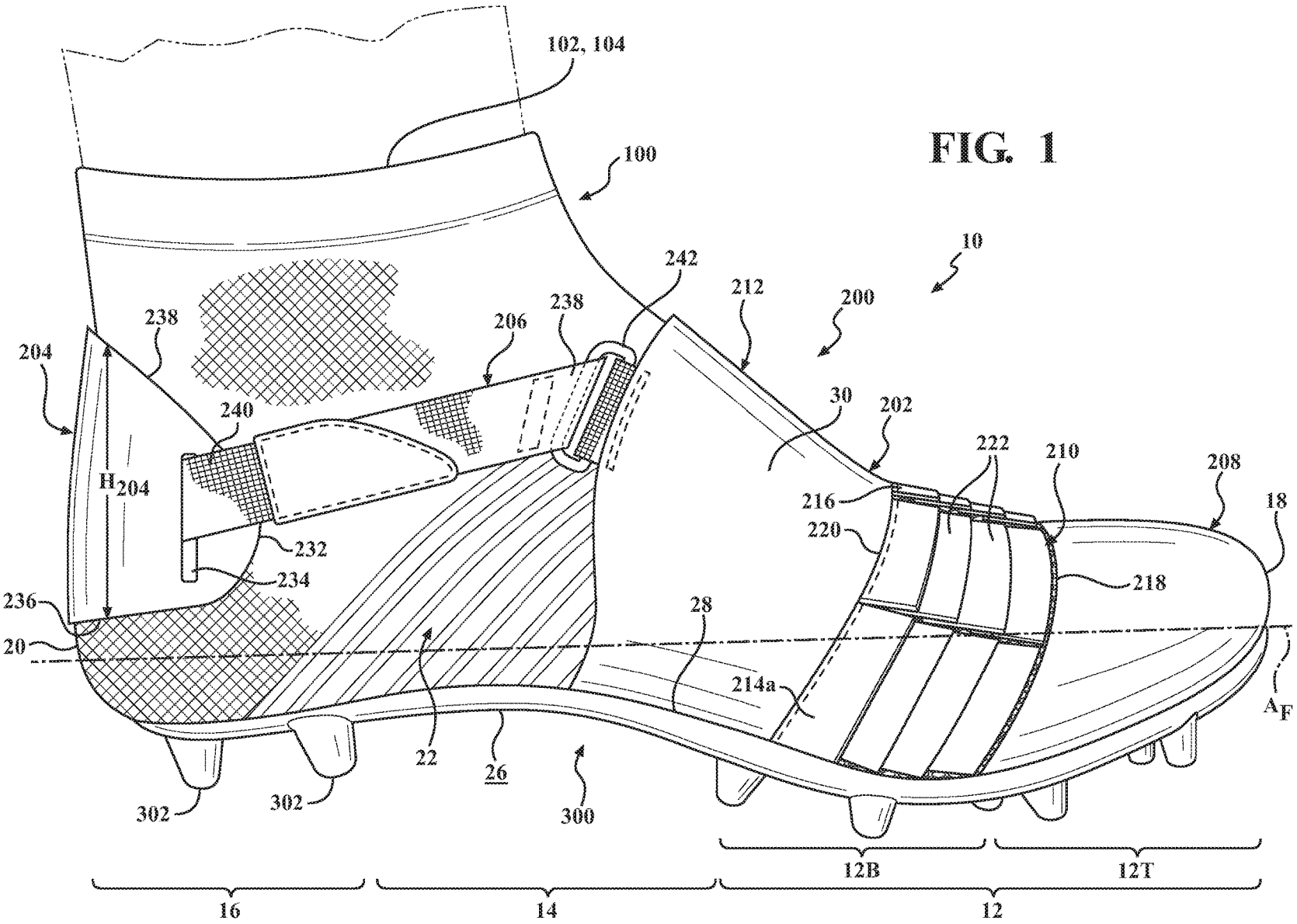
FIG. 1 is a perspective view of an article of footwear according to the principles of the present disclosure, showing the article of footwear in a first configuration.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides an article of footwear including an upper formed of a first material, and an armor system including a shroud covering a forefoot region of the upper. The shroud includes an articulable shroud vamp having a plurality of overlapping lames arranged in series along a ball portion of the shroud, each of the lames being formed of a second material having a greater hardness than the first material.

Implementations of the disclosure may include one or more of the following optional features. In some implementations, the shroud includes a toe cap covering a toe portion of the upper and a saddle covering a mid-foot region of the upper, the shroud vamp being disposed between the toe cap and the saddle. The saddle and the toe cap may be formed of the second material.

In some configurations, the second material is an up-cycled polyethylene composite.

In some examples, the upper includes an articulable upper vamp formed of the first material. In some configurations, the first material may have a greater elasticity than the second material.

In some configurations, the shroud vamp includes a plurality of rows of the overlapping lames. The plurality of rows may include a first row extending along a medial side of the upper and a second row extending along a lateral side of the upper.

In some implementations, each of the lames is attached to a flexible base layer. In some examples, the flexible base layer may be part of the upper.

Another aspect of the disclosure provides an article of footwear including an upper having an articulable portion formed of a first material, and an armor system including a shroud covering a forefoot region of the upper. The shroud includes a shroud vamp having a plurality of overlapping lames arranged in series and covering the articulable portion of the upper, each of the lames being formed of a second material having a greater hardness than the first material. This aspect may include one or more of the following optional features.

In some configurations, the shroud includes a toe cap covering a toe portion of the upper and a saddle covering a mid-foot portion of the upper, the shroud vamp being disposed between the toe cap and the saddle. The saddle and the toe cap may be formed of the second material.

In some examples, the second material is an up-cycled polyethylene composite.

In some examples, the articulable portion of the upper is disposed in a forefoot region. In some configurations, the first material may have a greater elasticity than the second material.

In some configurations, the shroud vamp includes a plurality of rows of the overlapping lames. The plurality of rows may further include a first row extending along a medial side of the upper and a second row extending along a lateral side of the upper.

In some implementations, each of the lames is attached to a flexible base layer. In some examples, the flexible base layer may be the articulable portion of the upper.

Referring to FIGS. 1-4, an article of footwear 10 includes an upper 100, an armor system 200 extending at least partially over the upper 100, and a sole structure 300 attached to the bottom of the upper 100. The article of footwear 10 may be divided into one or more regions. The regions may include a forefoot region 12, a mid-foot region 14, and a heel region 16. The forefoot region 12 may be subdivided into a toe portion $\mathbf{12}_T$ corresponding with phalanges, and a ball portion $\mathbf{12}_B$ associated with metatarsal bones of a foot. The mid-foot region 14 may correspond with an arch area of the foot, and the heel region 16 may correspond with rear portions of the foot, including a calcaneus bone. The footwear 10 may further include an anterior end 18 associated with a forward-most point of the forefoot region 12, and a posterior end 20 associated with a rearward-most point of the heel region 16. A longitudinal axis $A_F$ of the footwear 10 extends along a length of the footwear 10 from the anterior end 18 to the posterior end 20, and generally divides the footwear 10 into a lateral side 22 and a medial side 24. Accordingly, the lateral side 22 and the medial side 24 respectively correspond with opposite sides of the footwear 10 and extend through the regions 12, 14, 16.

The sole structure 300 is attached to the bottom of the upper 100 and defines a ground-engaging surface 26 of the article of footwear 10. As referred to throughout the application and the accompanying claims, the article of footwear 10 includes a 'bite line' 28 formed where the upper 100 and the sole structure 200 intersect when the footwear 10 is assembled. Accordingly, the bite line 28 can extend entirely around the footwear 10.

Figure 4A:
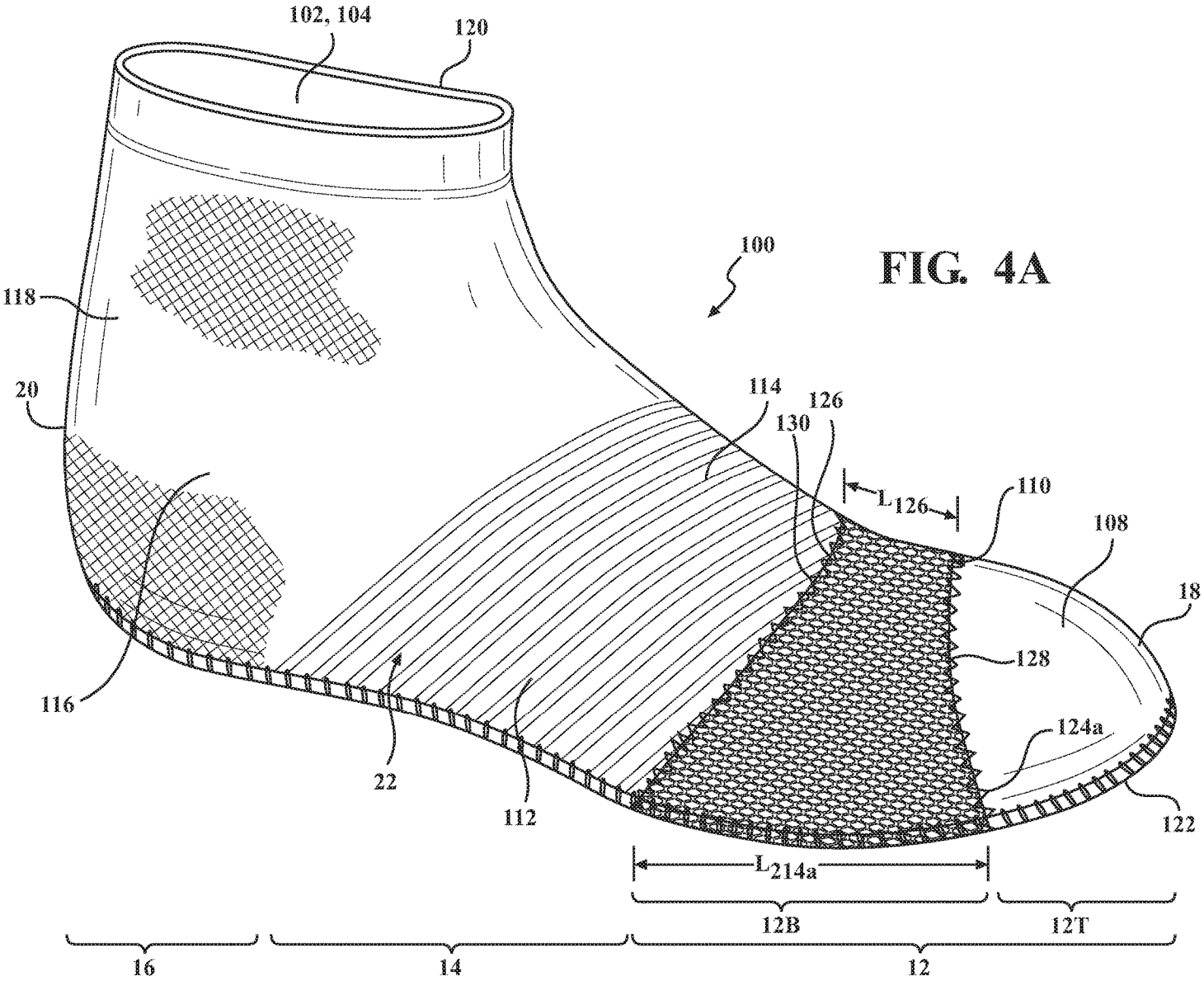
FIG. 4A is a lateral-side perspective view of an upper of an article of footwear according to the principles of the present disclosure.
Figure 4B:
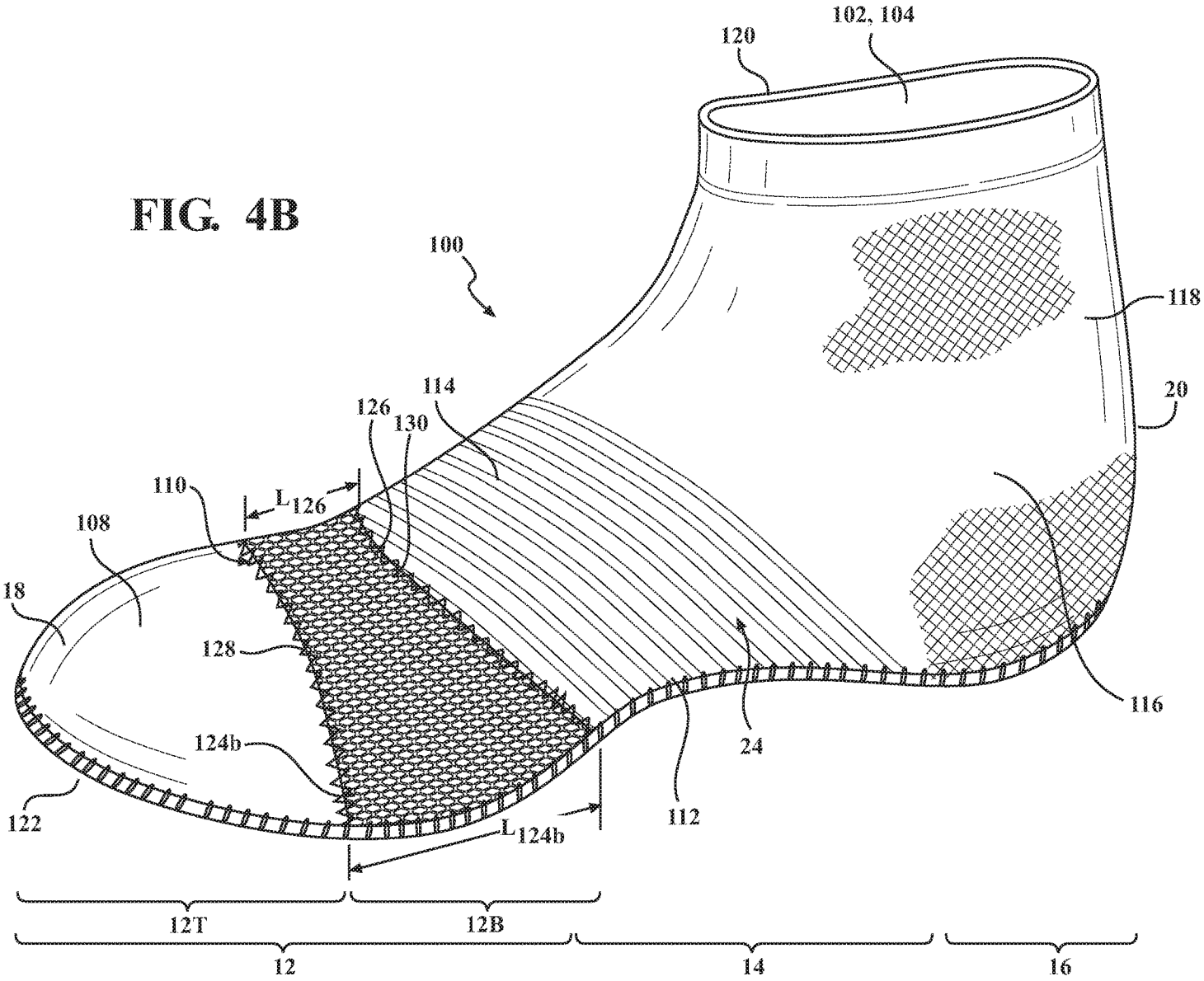
FIG. 4B is a medial-side perspective view of an upper of an article of footwear according to the principles of the present disclosure.

With reference to FIGS. 4A and 4B, the upper 100 includes a plurality of components that cooperate to define an interior void 102 and an ankle opening 104, which cooperate to receive and secure a foot for support on the sole structure 300. The components of the upper 100 may be formed from one or more materials that are stitched or adhesively bonded together to define the interior void 102. Suitable materials of the upper 100 may include, but are not limited to, textiles, foam, leather, and synthetic leather. The example upper 100 may be formed from a combination of one or more substantially inelastic or non-stretchable materials and one or more substantially elastic or stretchable materials disposed in different regions of the upper 100 to facilitate movement of the upper 100 between the tightened state and the loosened state. The one or more elastic materials may include any combination of one or more elastic fabrics such as, without limitation, spandex, elastane, rubber or neoprene. The one or more inelastic materials may include any combination of one or more of thermoplastic polyurethanes, nylon, leather, vinyl, or another material/fabric that does not impart properties of elasticity.

As shown in FIGS. 4A and 4B, the forefoot region 12 of the upper 100 includes a toe cap 108 disposed at the anterior end 18 and extending through the toe portion $\mathbf{12}_T$, and an upper vamp 110 disposed adjacent to the toe cap 108 and extending through the ball portion $\mathbf{12}_B$ of the forefoot region 12. As discussed in greater detail below, the toe cap 108 may be formed of a flexible, but inelastic material, while the upper vamp 110 is formed of a flexible, elastic material and is configured to allow the forefoot region 12 of the upper 100 to bend along the ball portion $\mathbf{12}_B$.

In the mid-foot region 14, the upper 100 includes a pair of quarter panels 112 disposed on opposite sides of the interior void 102, and a throat 114 that extends across the top of the upper 100 and defines an instep region 30 extending between the quarter panels 112 from the ankle opening 104 to the upper vamp 110. In the illustrated example, the throat 114 is integrally formed of a single, continuous piece of material with the quarter panels 112, whereby the throat extends between the opposing quarter panels in the instep region 30 to cover the interior void 102. In some examples, the throat 114 may be formed of a material having a higher modulus of elasticity than the material forming the quarter panels 112, thereby allowing the interior void 102 and the ankle opening 104 to expand to accommodate insertion of the foot of the wearer.

In the heel region 16, the upper 100 may further include heel side panels 116 extending through the heel region 16 along the lateral and medial sides 22, 24 of the ankle opening 104. A heel counter 118 wraps around the posterior end 20 of the footwear 10 and connects the heel side panels 116. Uppermost edges of the throat 114, the heel side panels 116, and the heel counter 118 cooperate to form a collar 120, which defines the ankle opening 104 of the interior void 102.

The upper 100 may include a strobel 122 having a bottom surface configured to oppose the sole structure 300 and an opposing top surface defining a footbed of the interior void 102. Stitching or adhesives may secure the strobel 122 to the upper 100. When the upper 100 is attached to the sole structure 300, a profile of the footbed is imparted to the strobel 122 by the sole structure 300, and may be contoured to conform to a profile of the bottom surface (e.g., plantar) of the foot. Optionally, the upper 100 may also incorporate additional layers such as an insole or sockliner that may be disposed upon the strobel 122 and reside within the interior void 102 of the upper 100 to receive a plantar surface of the foot to enhance the comfort of the article of footwear 10.

With continued reference to FIGS. 4A and 4B, the upper vamp 110 forms a continuous band extending laterally across the upper 100 from a lateral end 124*a* at the strobel 122 on the lateral side 22 to a medial end 124*b* at the strobel 122 on the medial side 24. An intermediate portion 126 of the upper vamp 110 is formed between the lateral end 124*a* and the medial end 124*b*, and extends over the instep of the upper 100. Generally, a length of the upper vamp 110 extends longitudinally from an anterior edge 128 disposed at a boundary of the toe portion $\mathbf{12}_T$ and the ball portion $\mathbf{12}_B$, to a posterior edge 130 disposed at a boundary of the ball portion $\mathbf{12}_B$ and the mid-foot region 14. Accordingly, as provided above, the upper vamp 110 extends through the ball portion $\mathbf{12}_B$ of the upper 100 with the anterior edge 128 attached to the toe cap 108 and the posterior edge 130 attached to the quarter panels 112 and the throat 114. In the illustrated example, the length of the upper vamp 110 tapers continuously from an end length $L_{124a}$, $L_{124b}$ at each of the lateral end 124*a* and the medial end 124*b* to an intermediate length $L_{126}$ at the intermediate portion 126 having a length $L_{126}$ that is less than the end lengths $L_{124a}$, $L_{124b}$. In some examples, each of the end lengths $L_{124a}$, $L_{124b}$ and the intermediate length $L_{126}$ may be the same. In other examples, the end lengths $L_{124a}$, $L_{124b}$ may be different from each other.

With continued reference to FIGS. 4A and 4B, the upper vamp 110 of the upper 100 forms a region of the upper 100 having a relatively high degree of flexibility. Accordingly, the upper vamp 110 may be formed of a different material than the other components of the upper 100. For example, the upper vamp 110 may be formed of one of the elastic materials, such as an elastic fabric. Additionally or alternatively, the upper vamp 110 may be formed using a different construction than the remainder of the upper 100. For example, the upper vamp 110 may be formed of a thinner material than the adjacent portions of the upper 100 (e.g., the toe cap 108 and the quarter panels 112).

By forming the upper vamp 110 to have a greater degree of flexibility and resiliency than the other components of the upper 100, the intermediate length $L_{126}$ of the upper vamp 110 is variable between an extended length when the toes are in an extended position (e.g., flat footed) and a retracted length when the toes are in a bent position (e.g., during push-off). Thus, the end lengths $L_{124a}$, $L_{124b}$ remain substantially constant along the bite line 28, while the intermediate portion 126 of the upper vamp 110 can be easily flexed between the extended position and the retracted position.

Figure 1B:
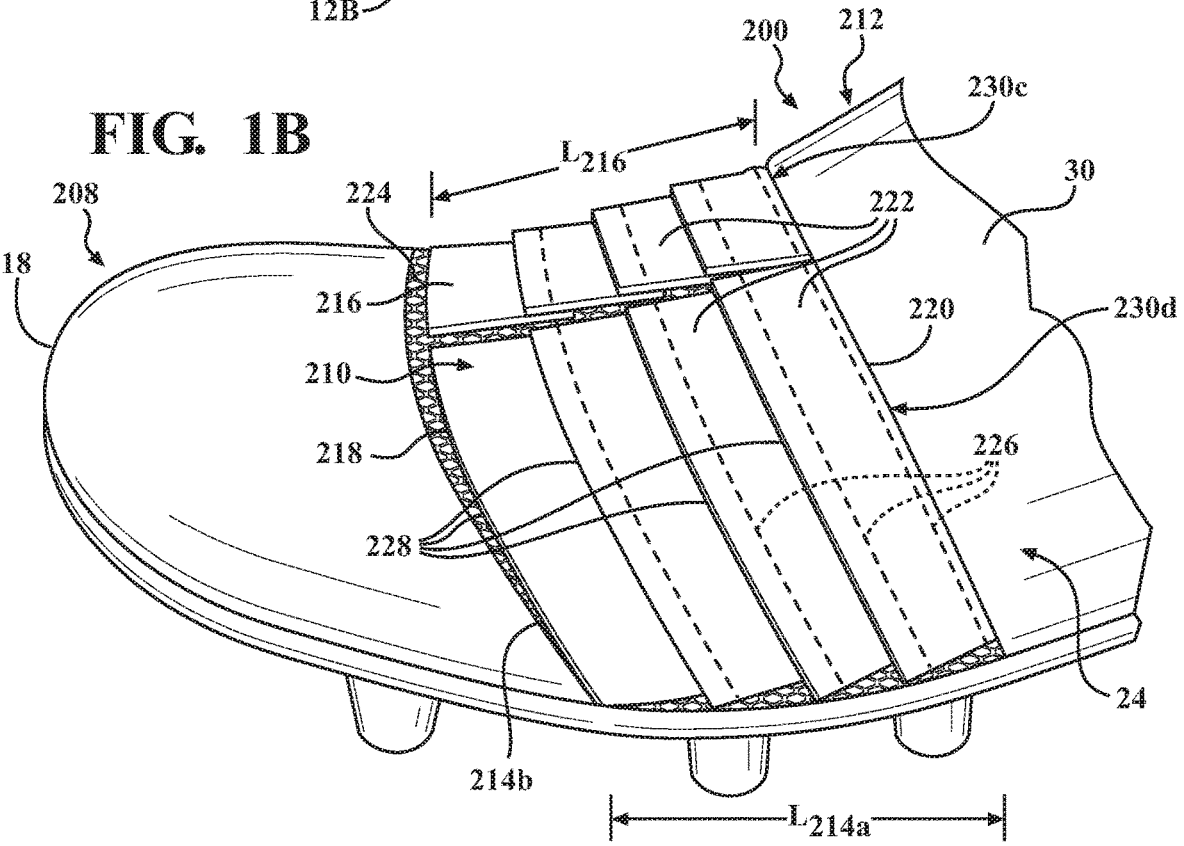
FIG. 1B is an enlarged fragmentary view of a medial side of a toe region of the article of footwear of FIG. 1.
Figure 2:
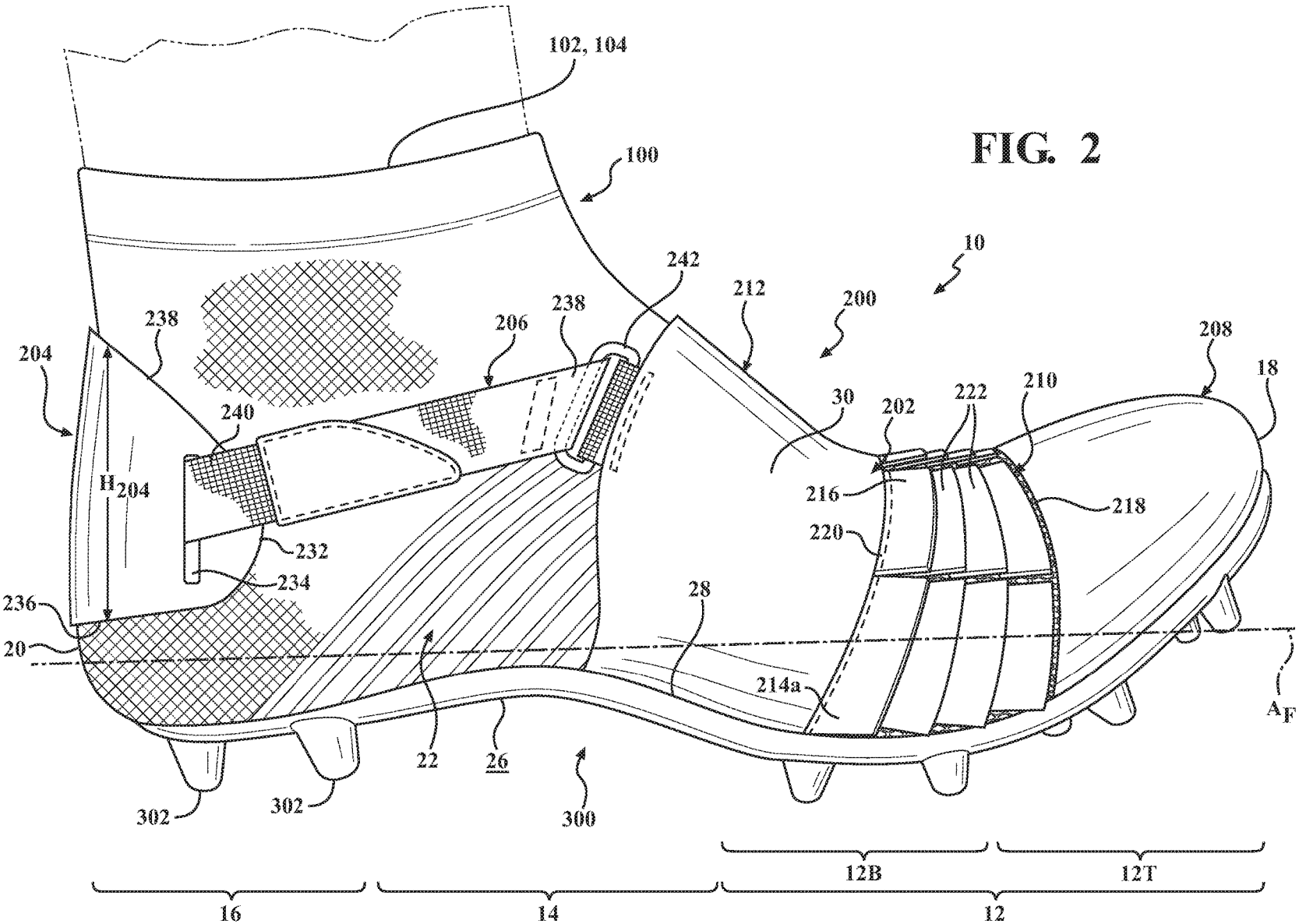
FIG. 2 is a perspective view of the article of footwear of FIG. 1, showing the article of footwear in a second configuration.
Figure 2A:
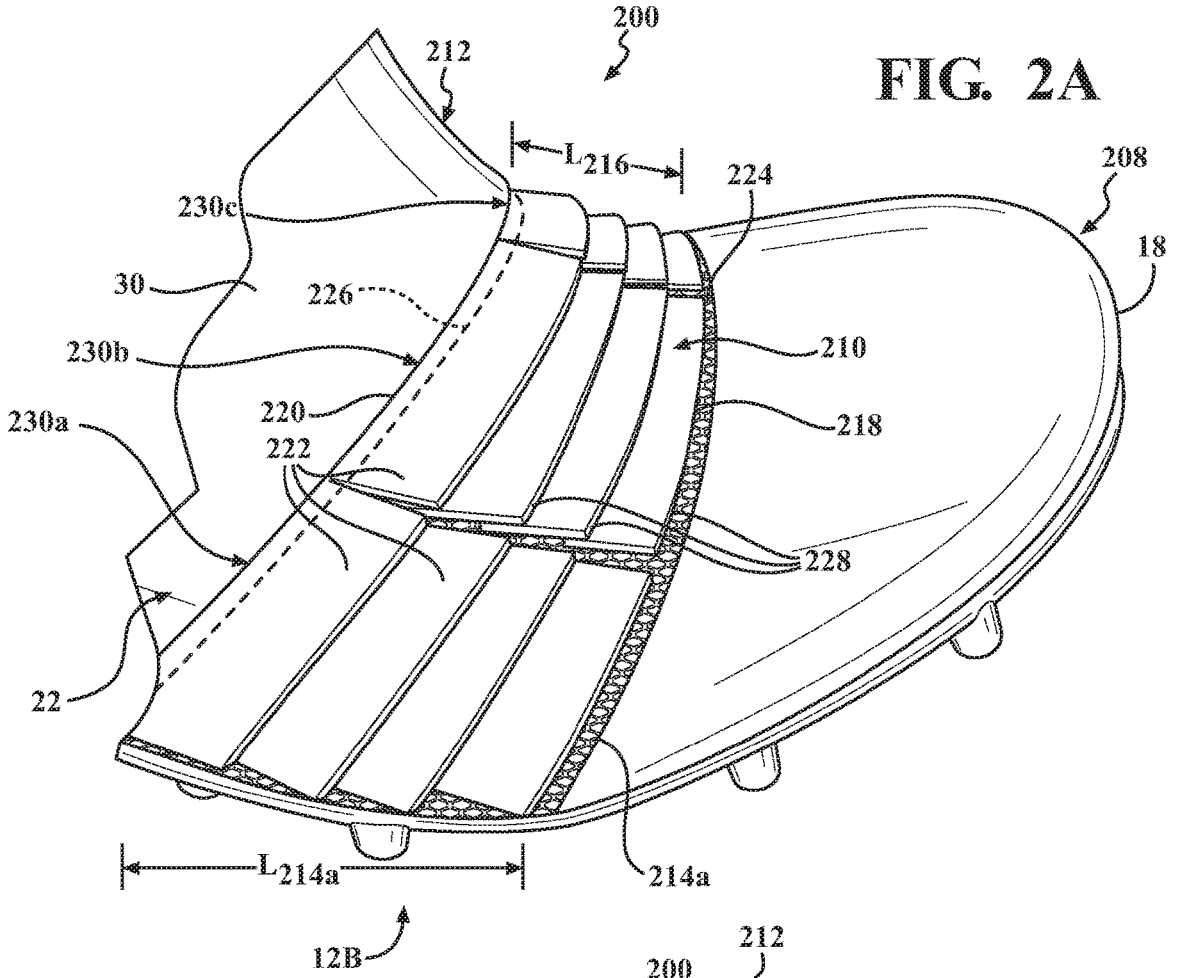
FIG. 2A is an enlarged fragmentary view of a lateral side of a toe region of the article of footwear of FIG. 2.
Figure 2B:
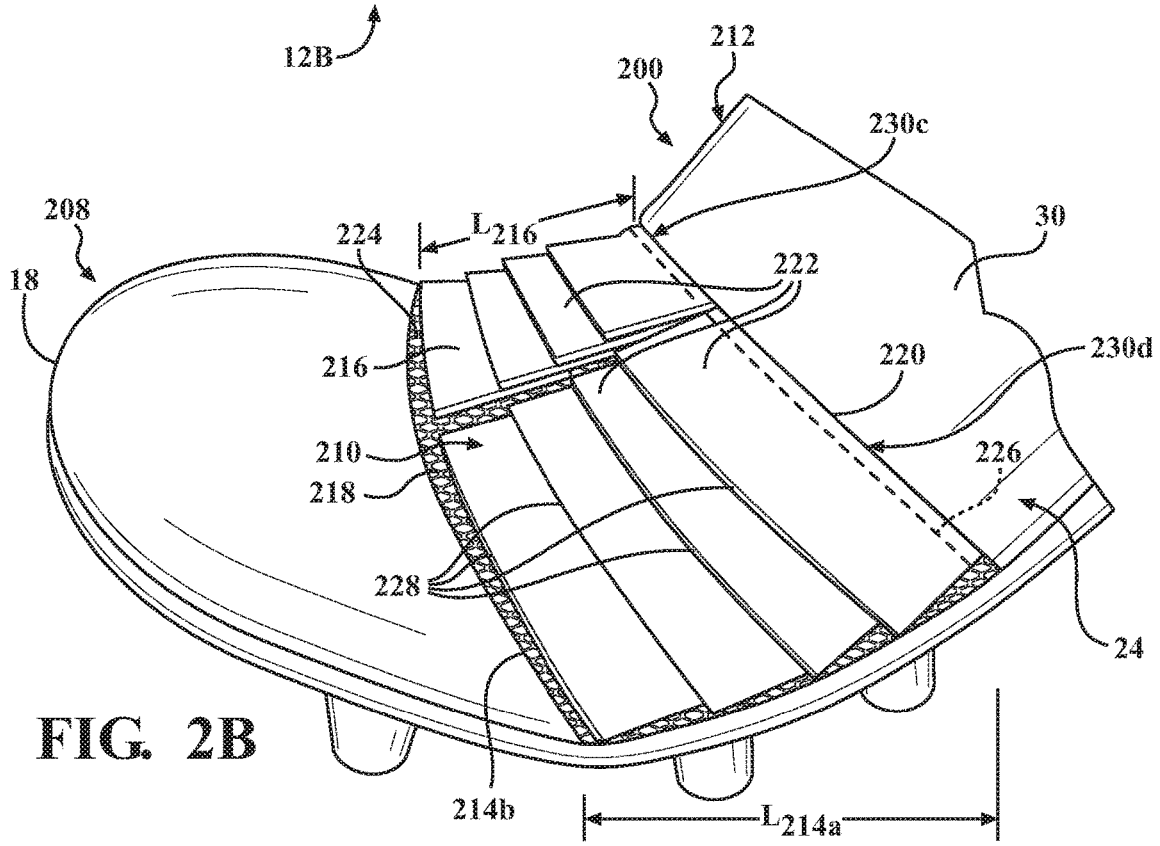
FIG. 2B is an enlarged fragmentary view of a medial side of a toe region of the article of footwear of FIG. 2.
Figure 3:
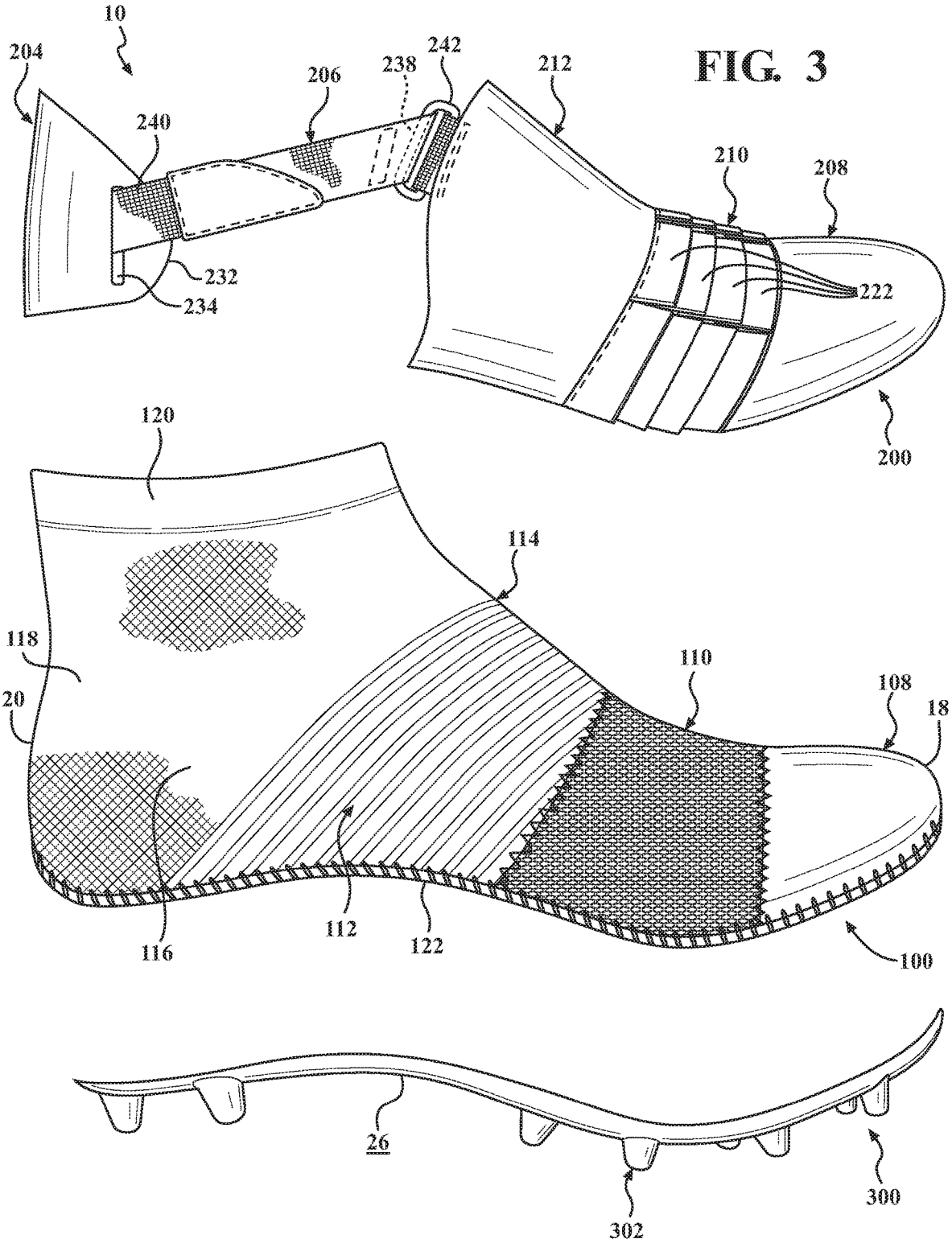
FIG. 3 is an exploded view of the article of footwear of FIG. 1.

Referring now to FIGS. 1-3, the armor system 200 includes a shroud 202 and a heel cap 204 attached to each other by a pair of adjustable straps 206. As described in greater detail below, each of the shroud 202 and the heel cap 204 includes materials that are configured to provide a protective layer over the exterior of the upper 100. Furthermore, the shroud 202 includes an articulable portion configured to allow the toe portion $\mathbf{12}_T$ of the shroud 202 and the article of footwear 10 to move freely between an extended position, shown in FIGS. 1-1B, and a bent position, shown in FIGS. 2-2B.

The shroud 202 and the heel cap 204 may both be at least partially formed from materials that have a greater hardness than the materials forming the upper 100, thereby providing a degree of protection to the exterior of the article of footwear 10. For example, the shroud 202 and the heel cap 204 may be formed of a rigid or semi-rigid polymeric or composite material. In other examples, the shroud 202 and/or the heel cap 204 may be formed of a flexible material such as, for example, natural or synthetic leather. While these components 202, 204 may be formed of a flexible material, these components 202, 204 may still include a relatively low modulus of elasticity when compared to the materials forming the upper 100. Regardless of the elasticity of the shroud 202 and the heel cap 204, one or both of these components 202, 204 may include one or more layers of padding.

The shroud 202 may be described as including a toe cap 208, a shroud vamp 210, and a saddle 212. The toe cap 208 is disposed over and covers the toe cap 108 of the upper 100. Likewise, the shroud vamp 210 of the shroud 202, as described in greater detail below, is disposed over the upper vamp 110 of the upper 100. The saddle 212 corresponds to and covers the quarter panels 112 and the throat 114 of the upper 100. Accordingly, the shroud vamp 210 is interposed between the toe cap 208 and the saddle 212, and is configured to provide an articulable joint between the toe cap 208 and the saddle 212.

In the illustrated example, the shroud vamp 210 forms a continuous band extending laterally across the shroud 202 from a lateral end 214*a* (FIGS. 1A and 2A) at the bite line 28 on the lateral side 22 to a medial end 214*b* (FIGS. 1B and 2B) at the bite line 28 on the medial side 24. An intermediate portion 216 of the shroud vamp 210 is formed between the lateral end 214*a* and the medial end 214*b*, and extends over the instep region 30 of the upper 100. Generally, a length of the shroud vamp 210 extends longitudinally from an anterior edge 218 disposed at a boundary of the toe portion $\mathbf{12}_T$ and the ball portion $\mathbf{12}_B$, to a posterior edge 220 disposed at a boundary of the ball portion $\mathbf{12}_B$ and the mid-foot region 14. Accordingly, as provided above, the shroud vamp 210 extends through the ball portion $\mathbf{12}_B$, whereby the anterior edge 218 is attached to the toe cap 208 and the posterior edge 220 is attached to the saddle 212. In the illustrated example, the length of the upper vamp 110 tapers continuously from an end length $L_{214a}$, $L_{214b}$ located at the lateral end 214*a* and the medial end 214*b*, respectively, to an intermediate length $L_{216}$ at the intermediate portion 216, whereby the intermediate length $L_{216}$ is less than the end lengths $L_{214a}$, $L_{214b}$. In some examples, the end lengths $L_{214a}$, $L_{214b}$ and the intermediate length $L_{216}$ may be same. In other examples, the end lengths $L_{214a}$, $L_{214b}$ may be different from each other.

With continued reference to FIG. 1-2B, the shroud vamp 210 forms a region of the shroud having a relatively high degree of flexibility. However, unlike the upper vamp 110, which is formed of a single piece of material having a relatively high degree of flexibility and elasticity, the shroud vamp 210 is formed of a plurality of rigid, overlapping lames 222 attached to a flexible and elastic base layer 224.

The lames 222 are arranged in series from the anterior edge 218 to the posterior edge 220 of the shroud vamp 210. Here, the overlapping ones of the lames 222 are configured to move relative to each other along the direction of the longitudinal axis $A_F$ to allow the shroud vamp 210 to move between an extended position (FIGS. 1-1B) and a retracted position (FIGS. 2-2B) while providing a continuous covering of the protective material. In some examples, the flexible base layer 224 may be the upper vamp 110, whereby the lames 222 are attached directly to the upper shroud 110. In other examples, the flexible base layer 224 may be formed as part of the shroud 202, separately from the upper vamp 110.

Figure 1A:
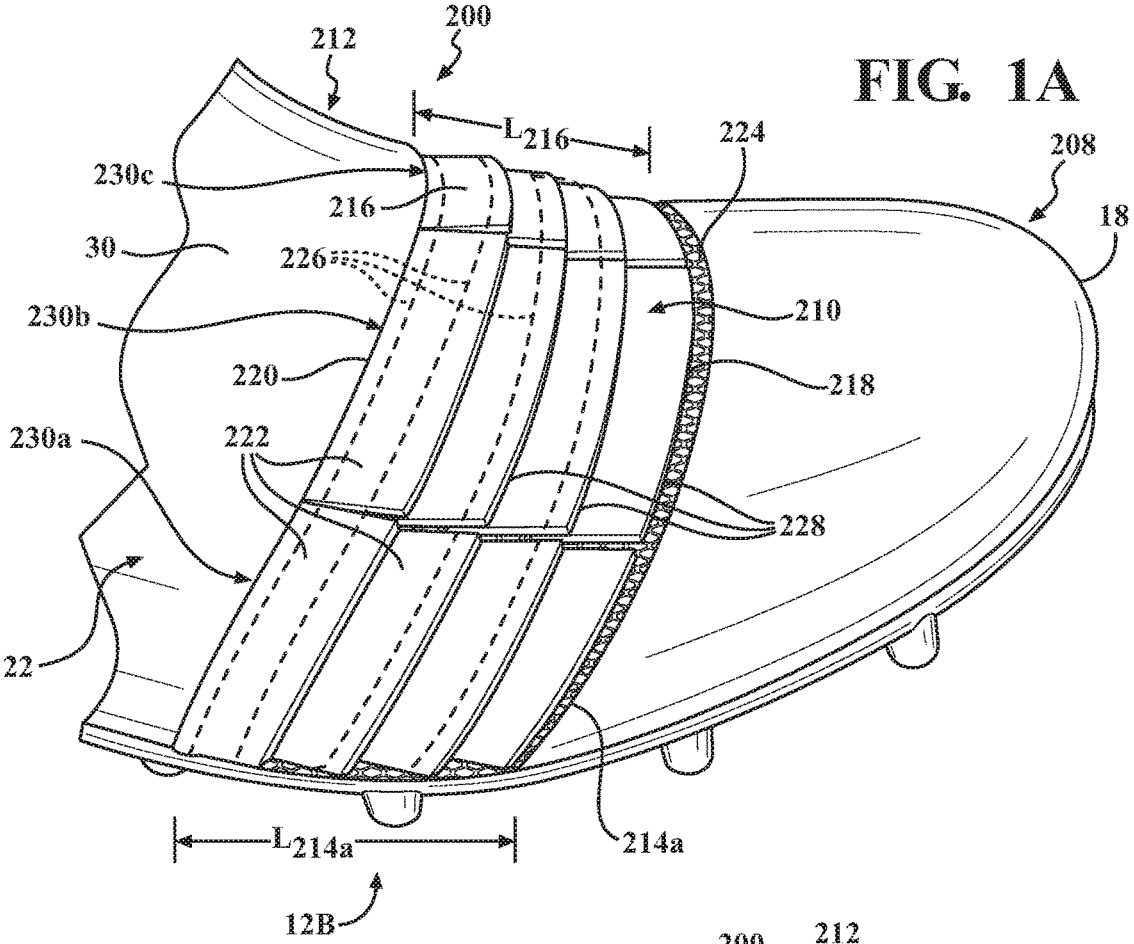
FIG. 1A is an enlarged fragmentary view of a lateral side of a toe region of the article of footwear of FIG. 1.

Referring to FIGS. 1A and 1B, lateral and medial sides 22, 24 of the shroud vamp 210 are shown with the shroud vamp 210 in an extended position. As shown, lengths of each of the lames 222 extend in a direction along the longitudinal axis $A_F$ from an attached proximal end 226 to a detached distal end 228. The lames 222 are arranged in a layered, overlapping configuration along the direction of the longitudinal axis $A_F$ from the posterior edge 220 to the anterior edge 218, whereby the proximal end 226 of a first one of the lames 222 in the series is attached at the posterior edge 220 of the shroud vamp 210, and a next one of the lames 222 has a proximal end 226 attached to the base layer 224 beneath the first one of the lames 222 (i.e., between the proximal end 226 and the distal end 228 of the first lame 222). Successive lames 222 are provided in a similar fashion to cover the base layer 224 with the distal end 228 of a final one of the lames 222 in the series being disposed adjacent to the anterior edge 218 of the shroud vamp 210.

Although the lames 222 of the illustrated example are shown as having a forward-extending arrangement, where respective proximal ends 226 face the posterior end 20 and distal ends 228 face the anterior end 18, the lames 222 may be arranged in an opposite, rearward-facing manner. For example, a first one of the lames 222 may extend from the proximal end 226 attached at the anterior edge 218 of the shroud vamp 210 to a detached distal end 228 closer to the posterior edge 220. As discussed above, successive ones of the lames 222 are then provided with proximal ends 226 disposed beneath the preceding lame 222 and distal ends 226 projecting rearwardly therefrom until a final one of the lames 222 is provided with the distal end 226 adjacent to the posterior edge 220 of the shroud vamp 210. Additionally or alternatively, one or more of the rows 230*a*-230*b* may have a forward-facing arrangement, while others of the rows have a rearward-facing arrangement.

With continued reference to FIGS. 1A and 1B, the lames 222 of the shroud vamp 210 are arranged in a plurality of rows 230*a*-230*d*, each including a series of the lames 222 extending from the posterior edge 220 to the anterior edge 218. The lames 222 of the plurality of rows 230*a*-230*d* are independently movable relative to each other within the respective rows 230*a*-230*d* and relative to lames 222 located in different rows 230*a*-230*d*. For example, lames 222 located in row 230*a* are independently movable relative to one another and are independently movable relative to lames 222 located in each of rows 230*b*-230*d*.

Referring to FIG. 1A, a width of a first one of the rows 230*a* extends from the bite line 28 to the instep region 30 on the lateral side 22. A second one of the rows 230*b* is adjacent to the first one of the rows 222*a*, and has a width extending through the instep region 30 on the lateral side 22. A third row 230*c* of the lames 222 is disposed adjacent to the second row 230*b* and extends along the instep region 30 on the medial side 24, and a fourth row 230*d* of the lames 222 extends from the instep region 30 on the medial side 24 to the bite line 28 on the medial side 24, as shown in FIG. 1B. The lames 222 forming each row 230*a*-230*b* may be uniquely contoured to conform to the profile of the top of the foot.

Although four rows 230*a*-230*d* of lames 222 are shown in the illustrated example, other examples may include different numbers of rows. In some examples, a single row of lames 222 may extend continuously from the bite line 28 on the lateral side 22 to the bite line 28 on the medial side 24, whereby each of the lames 222 is curved over the instep region 30 of the upper 100. In other examples, a plurality of substantially straight or flat lames 222 may be arranged in a desired number of rows to cover the upper vamp 110.

As shown in FIGS. 1-2B, when the toe portion $\mathbf{12}_T$ of the article of footwear 10 is moved between the extended position (FIGS. 1-1B) and the bent position (FIGS. 2-2B), the overlap between adjacent ones of the lames 222 in each row 230*a*-230*b* will move between an extended configuration and a retracted configuration. For example, as shown in FIGS. 1-1B, when the toe portion $\mathbf{12}_T$ is in the extended position, the overlap between adjacent ones of the lames 222 will be minimized such that a greater portion of each lame 222 is exposed. Simultaneously, the base layer 224 will be in an extended or stretched position. Conversely, when the toe portion $\mathbf{12}_T$ is moved into the bent position, the overlap between adjacent ones of the lames 222 will be increased compared to the extended position such that less of each lame 222 is exposed, as shown in FIGS. 2-2B. Accordingly, the overlapping arrangement of the lames 222 allows the intermediate length $L_{216}$ of the shroud vamp 210 to change freely, while maintaining a continuous covering of the protective lames 222.

Referring again to FIG. 1, the heel cap 204 is formed of a rigid or semi-rigid material, and extends around the heel counter 118 of the upper 100 from a first end 232 on the lateral side 22 to a second end (not shown) on the medial side 24. Because the first end 232 and the second end of the heel counter 118 are substantially identical, only the first end 232 is shown and described herein. The first end 232 and the second end are each attached to the shroud 202 by one of the straps 206. In the illustrated example, each end 232 includes a slot 234 through which the strap 206 is routed. In other examples, the straps 206 may be attached to the ends 232 by independent fasteners, such as snaps, buttons, hooks, adhesives, hook-and-loop fabrics, or the like.

Generally, the heel cap 204 is configured to provide protection to the Achilles region of the ankle and may be formed from the same material as the shroud 202. Accordingly, the heel cap 204 extends from a lower edge 236 adjacent to the heel to an upper edge 238 extending around the Achilles region. A height $H_{204}$ of the heel cap 204 may taper from an intermediate portion at the posterior end 20 of the upper 100 to each of the ends 232. Accordingly, one or both of the lower and upper edges 236, 238 may extend along an arcuate path from the first end 232 to the second end.

As discussed above, the shroud 202 and the heel cap 204 are formed of rigid or semi-rigid materials to provide a degree of protection to the upper 100 of the footwear, particularly in regions of the foot where localized impacts are likely to occur. Although the shroud 202 and the heel cap 204 may be formed of any rigid or semi-rigid material, such as polymeric materials and composites, the shroud 202 and the heel cap 204 of the illustrated example are formed from an up-cycled polyethylene composite material, referred to hereinafter as the "armored material." Initially, the polyethylene for the armored material may be provided by shredding previously used garments including polyethylene threads, such as athletic jerseys. The shredded polyethylene is then processed to form a woven polyethylene fabric sheet, which is casted in a thermoformed resin to form sheets of the armored material. The armored material can then be laser cut to form component blanks corresponding to the toe cap 208, the lames 222 of the shroud vamp 210, the saddle 212, and the heel cap 204. The respective blanks are then heat formed into the desired shape to provide the finished components 204, 208, 212, 222, which are assembled to the article of footwear 10 to provide the armor system 200.

Referring again to FIG. 1, the armor system 200 may include a pair of the straps 206, with a first one of the straps 206 connecting the shroud 202 to the heel cap 204 on the lateral side 22 and a second one of the straps (not shown) connecting the shroud 202 to the heel cap 204 on the medial side 24. Accordingly, each strap 206 extends from a first end 238 attached to the saddle 212 to a second end 240 attached to one of the ends 232 of the heel cap 204. At least one of the ends 238, 240 may be adjustable to control an overall length of the strap 206. In the illustrated example, the first end 238 includes a buckle 242 attached at a posterior edge of the saddle 212, while the second end 240 is looped through the slot 234 and folded over upon itself to adjust an overall length of the strap 206. Accordingly, the second end 240 of the strap 206 may include a fastener, such as hook-and-loop fabric or snaps, for securing the second end 240 of the strap 206 to an intermediate portion of the strap 206. The adjustability of the strap 206 allows a fit of the armor system 200 to be adjusted around the foot to secure the footwear 10 to the foot.

As provided above, the sole structure 300 is attached to the bottom of the upper 100 and defines the ground-engaging surface 26 of the article of footwear 10. In some examples, the sole structure 300 may be formed of a relatively hard polymeric material, and includes a plurality of ground engaging features 302, such as studs or cleats, configured to interface with the ground surface. While the armor system 200 is described and shown in conjunction with a sole structure 300 having studs or cleats, the aforementioned upper 100 and armor system 200 may be used in combination with cushioning sole structures and/or sole structures without such ground-engaging features.

The following Clauses provide an exemplary configuration for an article of footwear described above.

Clause 1: An article of footwear comprising an upper formed of a first material, and an armor system including a shroud covering a forefoot region of the upper, the shroud including an articulable shroud vamp having a plurality of overlapping lames arranged in series along a ball portion of the shroud, each of the lames being formed of a second material having a greater hardness than the first material.

Clause 2: The article of footwear of Clause 1, wherein the shroud includes a toe cap covering a toe portion of the upper and a saddle covering a mid-foot region of the upper, the shroud vamp being disposed between the toe cap and the saddle.

Clause 3: The article of footwear of Clause 2, wherein the saddle and the toe cap are formed of the second material.

Clause 4: The article of footwear of Clause 1, wherein the second material is an up-cycled polyethylene composite.

Clause 5: The article of footwear of Clause 1, wherein the upper includes an articulable upper vamp formed of the first material.

Clause 6: The article of footwear of Clause 5, wherein the first material has a greater elasticity than the second material.

Clause 7: The article of footwear of Clause 1, wherein the shroud vamp includes a plurality of rows of the overlapping lames.

Clause 8: The article of footwear of Clause 7, wherein the plurality of rows includes a first row extending along a medial side of the upper and a second row extending along a lateral side of the upper.

Clause 9: The article of footwear of Clause 1, wherein each of the lames is attached to a flexible base layer.

Clause 10: The article of footwear of Clause 9, wherein the flexible base layer is part of the upper.

Clause 11: An article of footwear comprising an upper having an articulable portion formed of a first material, and an armor system including a shroud covering a forefoot region of the upper, the shroud including a shroud vamp having a plurality of overlapping lames arranged in series and covering the articulable portion of the upper, each of the lames being formed of a second material having a greater hardness than the first material.

Clause 12: The article of footwear of Clause 11, wherein the shroud includes a toe cap covering a toe portion of the upper and a saddle covering a mid-foot portion of the upper, the shroud vamp being disposed between the toe cap and the saddle.

Clause 13: The article of footwear of Clause 12, wherein the saddle and the toe cap are formed of the second material.

Clause 14: The article of footwear of Clause 11, wherein the second material is an up-cycled polyethylene composite.

Clause 15: The article of footwear of Clause 11, wherein the articulable portion of the upper is disposed in a forefoot region.

Clause 16: The article of footwear of Clause 11, wherein the first material has a greater elasticity than the second material.

Clause 17: The article of footwear of Clause 11, wherein the shroud vamp includes a plurality of rows of the overlapping lames.

Clause 18: The article of footwear of Clause 17, wherein the plurality of rows includes a first row extending along a medial side of the upper and a second row extending along a lateral side of the upper.

Clause 19: The article of footwear of Clause 11, wherein each of the lames is attached to a flexible base layer.

Clause 20: The article of footwear of Clause 19, wherein the flexible base layer is the articulable portion of the upper.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

The invention claimed is:

1. An article of footwear comprising:

an upper including a flexible base layer formed of a first material, the upper extending from a heel portion, through a mid-foot portion, toward a toe portion of the article of footwear; and an armor system including a shroud, the shroud being disposed solely in the mid-foot portion and the toe portion of the article of footwear, the shroud including an articulable shroud vamp having a plurality of overlapping lames arranged in series along a ball portion of the shroud, each of the lames being formed of a second material having a greater hardness than the first material, wherein a first lame of the plurality of overlapping lames includes a posterior end and an anterior end, the posterior end attached to a posterior edge of the shroud vamp, and wherein a second lame of the plurality of overlapping lames includes a posterior end, the anterior end of the first lame disposed above and in contact with the posterior end of the second lame forming a portion of the layered series, and wherein the posterior end of the second lame of the plurality of overlapping lames is directly attached to the flexible base layer.

2. The article of footwear of claim 1, wherein the shroud includes a toe cap covering at least part of the toe portion of the upper and a saddle covering at least part of the mid-foot portion of the upper, the shroud vamp being disposed between the toe cap and the saddle, wherein the saddle and the toe cap are formed of the second material.

3. The article of footwear of claim 1, wherein the second material is a polyethylene composite.

4. The article of footwear of claim 1, wherein the upper includes an articulable upper vamp formed of the first material, wherein the first material has a greater elasticity than the second material.

5. The article of footwear of claim 1, wherein the shroud vamp includes a plurality of rows of the overlapping lames, wherein each of the plurality of rows of overlapping lames are separated in a lateral-medial direction from an adjacent row of overlapping lames by a gap extending lengthwise in a posterior-anterior direction of the article of footwear, and wherein the plurality of rows of the overlapping lames includes three or more rows.

6. An article of footwear comprising:

an upper having an articulable portion, the articulable portion including a flexible base layer formed of a first material; and an armor system including a shroud covering a forefoot portion of the upper, the shroud including a shroud vamp having a plurality of rows of overlapping lames arranged in series and covering the flexible base layer of the upper, each of the lames being formed of a second material having a greater hardness than the first material, wherein each of the plurality of rows of overlapping lames are separated in a lateral-medial direction from an adjacent row of overlapping lames by a gap extending lengthwise in a posterior-anterior direction of the article of footwear, the articulable portion of the upper being positioned below each gap, wherein the plurality of rows of overlapping lames includes a first row, wherein a first end of a first lame of the first row is directly attached to the shroud, and a first end of a second lame of the first row is directly attached to the flexible base layer of the upper below the first lame, a second end of the first lame covering a top of the first end of the second lame.

7. The article of footwear of claim 6, wherein the shroud includes a toe cap covering at least part of a toe portion of the upper and a saddle covering at least part of a mid-foot portion of the upper, the shroud vamp being disposed only between the toe cap and the saddle, wherein the saddle and the toe cap are formed of the second material.

8. The article of footwear of claim 6, wherein the second material is a polyethylene composite.

9. The article of footwear of claim 6, wherein the articulable portion of the upper is disposed in the forefoot portion.

10. The article of footwear of claim 6, wherein the first material has a greater elasticity than the second material.

11. The article of footwear of claim 1, wherein the armor system further includes a heel cap disposed in the heel portion and a fastener, wherein the heel cap is coupled to the shroud via the fastener, wherein the fastener includes one or more straps, and wherein the heel cap is disposed solely in the heel portion.

12. The article of footwear of claim 1, wherein the shroud vamp is movable between a retracted position and an extended position, and the plurality of overlapping lames are configured to provide a continuous covering of protective material over the length of the shroud vamp in both the retracted position and the extended position.

13. The article of footwear of claim 12, wherein a posterior lame of the plurality of overlapping lames extends over a posterior edge of an immediately adjacent lame in both the retracted position and the extended position.

14. The article of footwear of claim 5, wherein the shroud vamp is movable between a retracted position and an extended position, and each given row of the plurality of overlapping lames is configured to provide a continuous covering of protective material over the length of the shroud vamp, along the given row, in both the retracted position and the extended position.

15. The article of footwear of claim 6, wherein the plurality of rows of overlapping lames further includes:

a third lame of the first row, the third lame including a first end directly attached to the flexible base layer of the upper below the second lame, wherein a second end of the second lame covers a top of the first end of the third lame.

16. The article of footwear of claim 15, wherein the plurality of rows of overlapping lames includes a second row, the second row further including:

a first lame of the second row, the first lame including a first end directly attached to the shroud;

a second lame of the second row, the second lame including a first end directly attached to the flexible base layer of the upper below the first lame, and a second end of the first lame covering a top of the first end of the second lame; and a third lame of the second row, the third lame including a first end directly attached to the flexible base layer of the upper below the second lame, and a second end of the second lame covering a top of the first end of the third lame.

17. The article of footwear of claim 16, wherein each of the first end of the second lame of the first row, the first end of the third lame of the first row, the first end of the second lame of the second row, and the first end of the third lame of the second row are stitched to the flexible base layer.

18. The article of footwear of claim 6, wherein the upper further includes, a toe cap formed of a second material different than the first material, and a throat formed of a third material different from the first material and the second material, and wherein each of the plurality of rows of overlapping lames is formed of a fourth material having a greater hardness than the first material, the second material, and the third material.

* * * * *